US010575615B2

(12) United States Patent
Johnson

(10) Patent No.: US 10,575,615 B2
(45) Date of Patent: Mar. 3, 2020

(54) HAIR ACCESSORY

(71) Applicant: Michelle Johnson, Los Angeles, CA (US)

(72) Inventor: Michelle Johnson, Los Angeles, CA (US)

( * ) Notice: Subject to any disclaimer, the term of this patent is extended or adjusted under 35 U.S.C. 154(b) by 235 days.

(21) Appl. No.: 15/804,580

(22) Filed: Nov. 6, 2017

(65) Prior Publication Data

US 2019/0133285 A1 May 9, 2019

(51) Int. Cl.

| | |
|---|---|
| ***A45D 2/42*** | (2006.01) |
| ***A45D 7/00*** | (2006.01) |
| ***A45D 8/20*** | (2006.01) |
| ***A45D 8/30*** | (2006.01) |

(52) U.S. Cl.

CPC ..... *A45D 2/42* (2013.01); *A45D 7/00* (2013.01); *A45D 8/20* (2013.01); *A45D 8/30* (2013.01)

(58) Field of Classification Search

CPC ... A44B 9/00; A45D 2/42; A45D 7/00; A45D 8/24; A01K 13/005

USPC ..... 132/276, 273, 279

See application file for complete search history.

(56) References Cited

U.S. PATENT DOCUMENTS

| | | | | | |
|---|---|---|---|---|---|
| 4,503,870 | A * | 3/1985 | Peterson | A45D 7/04 | 132/270 |
| 5,495,861 | A * | 3/1996 | Liberman | A45D 8/34 | 132/273 |
| 5,535,765 | A * | 7/1996 | Takashima | A45D 8/34 | 132/273 |
| 6,089,240 | A * | 7/2000 | Chang | A45D 8/34 | 132/273 |
| 6,276,368 | B1 * | 8/2001 | Giamalva | A45D 8/36 | 132/201 |
| 6,439,242 | B1 * | 8/2002 | Head | A45D 8/00 | 132/273 |
| D463,624 | S * | 9/2002 | Oduber | D28/54.1 | |
| D526,442 | S * | 8/2006 | Kim | D28/41 | |
| 7,963,289 | B1 * | 6/2011 | King | A45D 8/34 | 132/106 |
| 2003/0121526 | A1 * | 7/2003 | Tobin | A45D 8/20 | 132/276 |
| 2013/0160784 | A1 * | 6/2013 | Loredo | A45D 8/28 | 132/200 |
| 2013/0192626 | A1 * | 8/2013 | Cohen | A45D 8/00 | 132/275 |

FOREIGN PATENT DOCUMENTS

| | | | | |
|---|---|---|---|---|
| WO | WO-2012010814 A1 * | 1/2012 | ..... | A41G 5/0053 |

* cited by examiner

*Primary Examiner* — Justin M Jonaitis

(57) ABSTRACT

A weighted hair accessory device is provided, wherein the hair accessory device includes a main body including a first movable arm and a second movable arm, wherein the main body is configured to move between an open and a closed position; a hinge element pivotally connecting a first end of the first movable arm to a first end of the second movable arm; and a securing device having a first latching element located at a second end of the first movable arm and a second latching element located at a second end of the second movable arm, wherein the securing device is configured to releasably secure the main body in the closed position. The hair accessory device is configured to apply weight to a portion of hair in order to straighten and/or prevent shrinkage of the portion of hair during drying, e.g., without the use of chemical substances or heat.

12 Claims, 3 Drawing Sheets

HAIR ACCESSORY

FIELD OF THE INVENTION

The present disclosure relates to a hair accessory and, more particularly, to a hair accessory which can be used as a weight in a user's hair.

BACKGROUND OF THE INVENTION

In daily life, many men and women wish to change or enhance characteristics of their natural hairstyle in order to express their individuality and a desired image of themselves. Various treatment products and equipment exist in the market that are capable of straightening, curling, securing, etc. a user's hair. However, many users wish to avoid the use of strong chemicals and/or heat treatment equipment, which can damage a hair.

It would thus be desirable to provide an improved and unobtrusive manner of straightening naturally curly or wavy hair in a way that avoids the use of chemicals and/or equipment which applies heat to a user's hair.

SUMMARY OF THE INVENTION

The above and other needs are met by aspects of the present disclosure which, in one particular aspect, provides an accessory device which can function as a weighted device for hair. In various embodiments, a hair accessory device comprising a pair of clamping arms hinged together to define the clamping arms of the hair accessory device is provided. The clamping arms are moveable between a first open position, wherein hair may be inserted or removed from the hair accessory device, and a second closed position, wherein hair is secured between the clamping arms of the hair accessory device.

In various embodiments, a weighted hair accessory device is provided, the hair accessory device comprising: a main body comprising a first movable arm and a second movable arm, wherein the main body is configured to move between an open position and a closed position; a hinge element pivotally connecting a first end of the first movable arm to a first end of the second movable arm; and a securing device comprising a first latching element located at a second end of the first movable arm and a second latching element located at a second end of the second movable arm, wherein the securing device is configured to releasably secure the main body in the closed position. The hair accessory device can be configured to apply weight to a portion of hair in order to straighten the portion of hair and/or reduce shrinkage of the portion of hair during drying. In various embodiments, the main body is cylindrical in shape when the hair accessory device is in the closed position.

The hair accessory devices disclosed herein may be weighted. As such, aspects of the present disclosure provide accessory devices for straightening hair in an unobtrusive and natural manner, wherein the hair accessory device can be suitably secured and readily removed from a user's hair, as necessary. In addition, the accessory devices of the present invention can be aesthetically pleasing.

In some embodiments, the hair accessory device has a weight in the range of about 1 gram to about 100 grams. In certain embodiments, the hair accessory device has a length in the range of about 0.1 inches to about 3 inches. In various embodiments, the hair accessory device has a width (or diameter) in the range of about 0.1 inches to about 3 inches. In various embodiments, the hair accessory device further comprises a plurality of teeth on at least a portion of an interior surface of at least one of the first movable arm and the second movable arm. In some embodiments, each of the plurality of teeth are triangular in shape.

A method of straightening hair is also provided herein. In various embodiments, the method comprises engaging at least one hair accessory device described herein with a portion of hair by closing the at least one hair accessory device around the portion of hair and securing the securing device such that the main body remains in the closed position around the portion of hair for a desired length of time. In certain embodiments, the method of straightening hair is substantially free of chemical products and heat treatment.

Further features and advantages of the present disclosure are set forth in more detail in the following description.

BRIEF DESCRIPTION OF THE DRAWINGS

In order to provide an understanding of aspects of the disclosure, reference is made to the appended drawings, which are not necessarily drawn to scale, and in which reference numerals refer to components of exemplary aspects of the disclosure. The drawings are exemplary only, and should not be construed as limiting the disclosure.

DETAILED DESCRIPTION OF THE DISCLOSURE

The present disclosure now will be described more fully hereinafter with reference to the accompanying drawings, in which some, but not all aspects of the disclosure are shown. Indeed, the disclosure may be embodied in many different forms and should not be construed as limited to the aspects set forth herein; rather, these aspects are provided so that this disclosure will satisfy applicable legal requirements. Like numbers refer to like elements throughout. As used in this specification and the claims, the singular forms "a," "an," and "the" include plural referents unless the context clearly dictates otherwise.

Aspects of the present disclosure provide hair accessory devices and methods for securing at least one accessory device to a user's hair. The hair accessory devices of the present invention can be weighted so as to provide some degree of straightening/lengthening to the user's hair. Such hair accessory devices can optionally, in some embodiments, further provide a decorative aspect.

Figure 1:
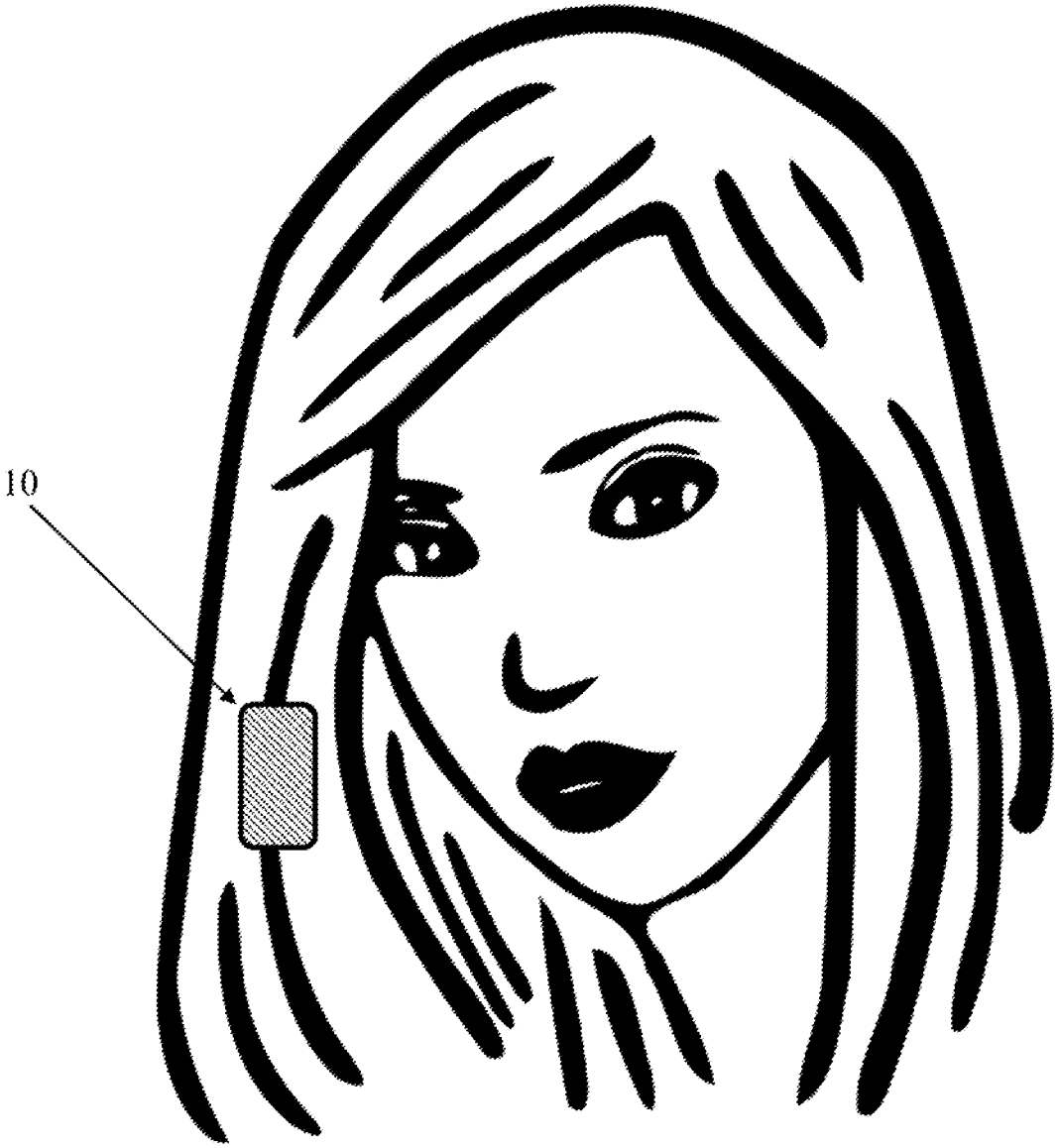
FIG. 1 is front view of a hair accessory device engaged with a portion of hair of a user, according to various aspects of the present disclosure.

As illustrated in FIG. 1, for example, a hair accessory device 10 of the present invention can enclose and fasten a section of hair. The hair accessory device 10 is engaged with a portion of hair of a user. Hair accessory devices of the present invention can be engaged with a portion of loose hair and/or with a portion of braided hair, and/or with a portion of twisted hair, for example. Without being limited by theory, when applied to a portion of loose and/or braided and/or twisted hair, hair accessory devices of the present invention can decrease shrinkage of the hair as it dries or sets, i.e., the hair accessory device of the present invention can weigh down the portion of hair engaged with the hair accessory device such that naturally curly or wavy hair exhibits a straightened or more loosely curled state after being dried and/or set with at least one hair accessory device engaged. Hair accessory devices of the present invention provide a chemical-free and heat-free way to straighten and lengthen hair. It is noted that although products of the present invention are designed to be used without chemicals and/or without heat, such use is not excluded from the present invention. In some embodiments, hair accessory devices disclosed herein can be used in combination with chemical and/or heat hair treatment products to enhance the effects of the chemicals and/or heat by providing, for example, greater straightening effects.

Figure 3:
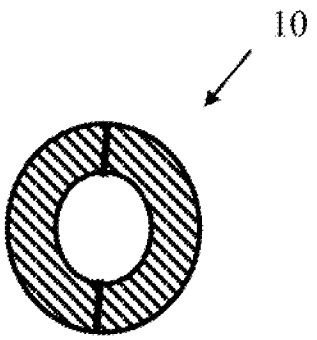
FIG. 3 is a top view of a hair accessory device in a closed position, according to various aspects of the present invention.
Figure 2:
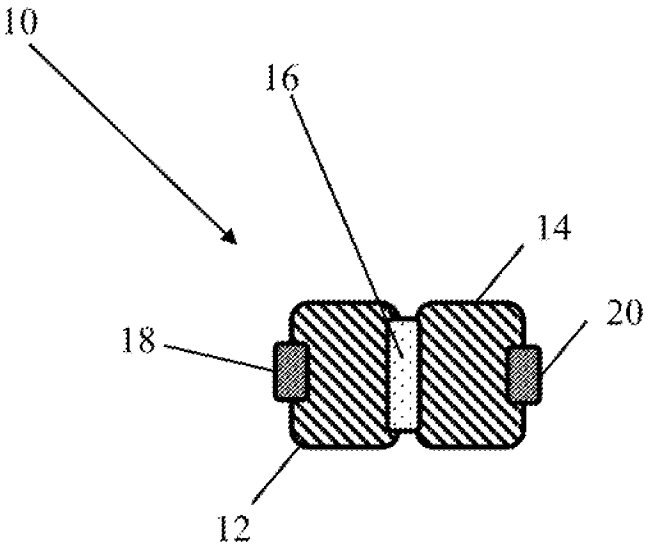
FIG. 2 is a front view of a hair accessory device in an unengaged and open position, according to various aspects of the present disclosure.

As illustrated in FIG. 2, for example, a hair accessory device 10 is shown in an unengaged and open condition. In various embodiments, the hair accessory device can comprise a first arm 12 and a second arm 14. The hair accessory device can further comprise a hinge element 16 pivotally connecting the first arm 12 to the second arm 14 such that the arms of the hair accessory device are moveable between an open position (see, e.g., FIG. 2) and a closed position (see, e.g., FIG. 3). Although the hair accessory devices pictured in the present application are cylindrical in shape, it is understood that different shapes are contemplated as part of the present invention. For example, the hair accessory device can be square, triangular, hexagonal, etc. In a closed position, the hair accessory device is generally hollow such that a portion of hair i enclosed therein.

Figure 4:
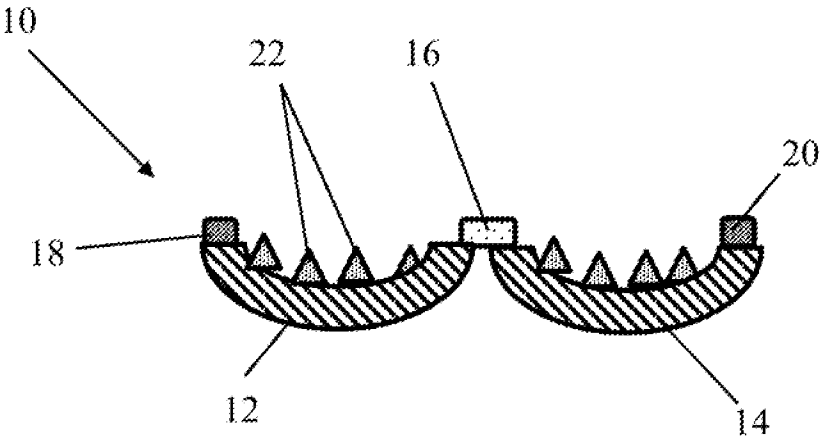
FIG. 4 is a side view of the interior surface of an arm of a hair accessory device, according to various aspects of the present invention.

In some embodiments, the first movable arm 12 is elongated and has a concave inner surface (i.e., curves inward similar to the interior of a circle or sphere), as illustrated in FIG. 4, for example. Similarly, in some embodiments, the second movable arm 14 is elongated and has a concave inner surface. When the hair accessory device is in the closed position, the first movable arm and the second movable arm can form a hollow, cylindrical shape.

Each arm of the hair accessory device can be of a uniform or variable thickness depending on the desired look, feel, and weight of the hair accessory device. For example, in certain embodiments, an arm of the hair accessory device can have a thickness in the range of about 0.1 mm to about 30 mm, or about 1 mm to about 15 mm. In certain embodiments, an arm of the hair accessory device can have a thickness of at least about 0.1 mm, at least about 5 mm, or at least about 10 mm.

The hair accessory device can further comprise at least one securing device comprising a first latching element 18 and a second latching element 20. The first latching element 18 and the second latching element 20 can be configured to operate with one another such that the hair accessory device can be locked in a closed position when it is engaged with a portion of hair. The first latching element 18 and the second latching element 20 can be further configured to releasably engage one another such that the hair accessory device can be moved to an open position for removal from a user's hair. The securing device (also referred to as a fastening device) can be located opposite from the hinge element when the hair accessory device is in a closed position. As such, a first end of a first arm 12 can be attached to the hinge element 16, and a second end of a first arm 12 can be attached to a first latching element 18. Similarly, a first end of a second arm 14 can be attached to the hinge element 16, and a second end of a first arm 14 can be attached to a second latching element 20. It will be understood that the hinge and fastening means described herein are well known in the prior art and per se form no part of the instant invention.

In various embodiments, the hair accessory device can further comprise a plurality of teeth 22 on an interior surface of at least one arm of the hair accessory device, as illustrated in FIG. 4, for example. In certain embodiments, both the first arm and the second arm comprise a plurality of teeth 22 attached to an interior surface of each arm. The plurality of teeth can help secure the hair accessory device at a desired location on the portion of hair which the hair accessory device is engaged. The plurality of teeth can allow for a greater surface area of the hair accessory device to be engaged with the portion of hair secured therein. In certain embodiments, each of the plurality of teeth can be triangular in shape. It is noted that an arm of the hair accessory device and the plurality of teeth associated with the arm can be formed as a single unit using a molding process during manufacture of the hair accessory device. Alternatively, an arm of the hair accessory device and the plurality of teeth associated therewith can be formed separately and attached to one another at a later time during the manufacturing process.

Various materials known in the art can be used to manufacture the various components of the hair accessory devices described herein. For example, elements of the hair accessory device can comprise molded plastic materials, composite materials, metals, woven materials, clay materials, and combinations thereof. In certain embodiments, elements of the hair accessory device can comprise light alternative metals such as alloys that contain nickel, plated gold or silver, copper, light weight gold/silver or gold/silver tone metals, various types of fiber/fabric silk, yak hair, wool, and combinations thereof. The unique materials used to make the hair accessory device can add to its functionality as a hair weight, i.e., weighting it down.

The hair accessory devices can be provided with different sizes and weights. In general, the hair accessory device is heavy enough to provide some amount of downward force on a user's hair when the hair accessory device is in use, i.e., to provide some straightening effect on the hair. However, the hair accessory device is typically not so heavy that it leads to significant discomfort for the user due to the downward force applied to the hair engaged with the hair accessory device. In certain embodiments, a hair accessory device can weigh about 1 gram to about 100 grams, or about 5 grams to about 50 grams, or about 10 grams to about 30 grams. In certain embodiments, a hair accessory device can weigh at least about 1 gram, at least about 5 grams, at least about 15 grams, at least about 25 grams, or at least about 40 grams (with a maximum weight of about 100 grams, for example).

In certain embodiments, a hair accessory device can be about 0.1 to about 3 inches in length, about 0.5 to about 2.5 inches in length, or about 1 to about 2 inches in length. In some embodiments, a hair accessory device can be at least about 0.1 inches in length, at least about 0.5 inches in length, or at least about 1 inch in length (with a maximum length of about 3 inches, for example). In certain embodiments, a hair accessory device can be about 0.1 to about 3 inches in width (or diameter depending on the shape of the hair accessory device), about 0.5 to about 2.5 inches in width, or about 1 to about 2 inches in width. In some embodiments, a hair accessory device can be at least about 0.1 inches in width, at least about 0.5 inches in width, or at least about 1 inch in width (with a maximum width of about 3 inches, for example).

In various embodiments of the present invention, the hair accessory device can be decorative in nature. The hair accessory device may be designed so as to be decorative, e.g., having a color and/or shape to provide a desirable appearance. In some embodiments, the exterior surface of the hair accessory device can be patterned and/or include 3-dimensional decorative components associated therewith (e.g., beads, sequins, molded plastic pieces, etc.). As such, the hair accessory device can provide a functional and aesthetic use.

As discussed above, the hair accessory devices disclosed herein provide a tool to assist with adding length to curly or coarse hair (e.g., naturally curly or coarse hair) through straightening and to prevent shrinkage of hair during drying. In various methods of using the hair accessory devices described herein, the device can be placed in the hair, secured along a braid, twist, or sectioned portion of hair. Many users with thick, curly, or wavy hair and, particularly, those users interested in wearing their hair in a largely natural form, will find the disclosed hair accessory devices very useful for avoiding shrinkage of the hair while drying, and providing lengthened and/or straightened hairstyles.

One or more hair accessory devices can be selected based on the weight thereof such that the desired bounce and length of the engaged hair can be achieved. The characteristics of a user's hair can also affect selection of the number of and/or weight of hair accessory devices selected. For example, thicker, coarser hair may require a heavier hair accessory device to achieve the same degree of straightening achieved for finer hair with a lighter hair accessory device. A user can also select one or more hair accessory devices based on the decorative aspects provided.

In some embodiments, a user can separate their hair into multiple portions of hair. Each portion of hair can have at least one hair accessory device applied thereto. In some embodiments, only some of the portions of hair can have at least one hair accessory device applied thereto. More than one hair accessory device can be engaged with the same portion of hair. For example, in certain embodiments, 1 or more, 5 or more, or 10 or more hair accessory devices can be used on a portion of hair. In certain embodiments, different portions of hair can have a different number of hair accessory devices and/or hair accessory devices having different weights applied thereto. As such, a user can vary the amount of lengthening/straightening achieved for different portions of hair.

In certain embodiments, the plurality of teeth present on an interior surface of the hair accessory device can assist with engaging the portion of hair. The hinged arms of the hair accessory device can be closed around the portion of hair and the securing device can be engaged to lock the hair accessory device in a closed position.

In various embodiments, one or more hair accessory devices can be engaged with a user's hair for a length of time sufficient to achieve a desired level of lengthening/straightening of the hair. For example, one or more hair accessory devices can be employed from the time the engaged hair is wet until it dries, or the one or more hair accessory devices can be employed beyond the time it takes for the hair to dry. In certain embodiments, one or more hair accessory devices can be engaged with one or more portions of dry hair and employed for a length of time sufficient to achieve a desired level of lengthening/straightening of the hair. In some embodiments, one or more hair accessory devices can be engaged with a portion of hair for at least about 30 mins, at least about 1 hour, at least about 3 hours, at least about 6 hours, at least about 12 hours, or at least about 24 hours. In certain embodiments, particularly when a hair accessory device is used for more decorative purposes, one or more hair accessory devices can be left engaged with a portion of hair for extended periods of time (e.g., one or more days).

EXPERIMENTAL

Aspects of the present invention are more fully illustrated by the following examples, which are set forth to illustrate certain aspects of the present invention and are not to be construed as limiting.

Example 1

A cylindrical hair accessory device was provided with a hinge connecting two pivotable sides (i.e., arms). The main body of the hair accessory device (i.e., the movable arms) is molded from a clay material. The hinge is located in the center of the hair accessory device. Plastic claws that can grasp the hair are provided on the interior surface of the hair accessory device. A clasp is located on the main body of the hair accessory device on a side opposite from (i.e., at an opposite end of the diameter of the main body of the hair accessory device in a closed position) the hinge connecting the two pivotable arms of the hair accessory device. Decorative features were added to the hair accessory device.

Example 2

Hair was straightened using a plurality of hair accessory devices described herein. A user's hair, while wet, was first divided into 6 separate portions.

On a first portion of hair, a first hair accessory device weighing approximately 30 grams was opened and closed around the first portion of hair. A clasp (i.e., securing device) was closed to secure the first hair accessory device.

On a second portion of hair, a second hair accessory device weighing approximately 30 grams was opened and closed around the bottom of the second portion of hair. A clasp (i.e., securing device) was closed to secure the second hair accessory device. Further up the second portion of hair (i.e., in a direction towards the user's scalp), a third hair accessory device weighing approximately 30 grams was opened and closed around the second portion of hair. A clasp (i.e., securing device) was closed to secure the third hair accessory device.

On a third portion of hair, a fourth hair accessory device weighing approximately 50 grams was opened and closed around the third portion of hair. A clasp (i.e., securing device) was closed to secure the fourth hair accessory device.

On a fourth portion of hair, a fifth hair accessory device weighing approximately 30 grams was opened and closed around the bottom of the fourth portion of hair. A clasp (i.e., securing device) was closed to secure the fifth hair accessory device. Further up the fourth portion of hair (i.e., in a direction towards the user's scalp), a sixth hair accessory device weighing approximately 50 grams was opened and closed around the fourth portion of hair. A clasp (i.e., securing device) was closed to secure the sixth hair accessory device.

On a fifth portion of hair, a seventh hair accessory device weighing approximately 20 grams was opened and closed around the bottom of the fifth portion of hair. A clasp (i.e., securing device) was closed to secure the seventh hair accessory device. Further up the fifth portion of hair (i.e., in a direction towards the user's scalp and approximately in the middle of the length of the fifth portion of hair), an eighth hair accessory device weighing approximately 20 grams was opened and closed around the middle of the second portion of hair. A clasp (i.e., securing device) was closed to secure the eighth hair accessory device. Further up the fifth portion of hair (i.e., in a direction towards the user's scalp and approximately at the top of the length of the fifth portion of hair), a ninth hair accessory device weighing approximately 20 grams was opened and closed around the top of the second portion of hair. A clasp (i.e., securing device) was closed to secure the ninth hair accessory device.

On a sixth portion of hair, no hair accessory devices are engaged with the hair.

The six portions of hair are allowed to dry naturally. After drying, each of the nine hair accessory devices were removed from the hair. The different portions of hair had different lengths and degrees of curl after drying with the different number and/or weight of hair accessory devices.

Many modifications and other aspects of the disclosure will come to mind to one skilled in the art to which this disclosure pertains having the benefit of the teachings presented in the foregoing description. Therefore, it is to be understood that the disclosure is not to be limited to the specific aspects disclosed and that modifications and other aspects are intended to be included within the scope of the appended claims. Although specific terms are employed herein, they are used in a generic and descriptive sense only and not for purposes of limitation.

What is claimed is:

1. A method of straightening hair comprising:

providing at least one hair accessory device, the at least one hair accessory device comprising:

a main body comprising a first movable arm and a second movable arm, wherein the main body is configured to move between an open position and a closed position;

a hinge element pivotally connecting a first end of the first movable arm to a first end of the second movable arm; and a securing device comprising a first latching element located at a second end of the first movable arm and a second latching element located at a second end of the second movable arm, wherein the securing device is configured to releasably secure the main body in the closed position;

wherein the at least one hair accessory device is configured to apply weight to a portion of hair in order to straighten the portion of hair and/or reduce shrinkage of the portion of hair during drying;

engaging the at least one hair accessory device with a portion of hair by closing the at least one hair accessory device around the portion of hair;

securing the securing device such that the main body remains in the closed position around the portion of hair for a length of time, wherein the length of time corresponds to a desired level of straightening of the portion of hair;

straightening the portion of hair to the desired level of straightening by leaving the at least one hair accessory device engaged with the portion of hair for the length of time; and removing the hair accessory device from the portion of hair after the desired level of straightening of the portion of hair is achieved.

2. The method of claim 1, wherein the method of straightening hair is substantially free of chemical products and heat treatment.

3. The method of claim 1, wherein the hair accessory device has a weight in the range of about 1 gram to about 100 grams.

4. The method of claim 1, wherein the hair accessory device has a length in the range of about 0.1 inches to about 3 inches.

5. The method of claim 1, wherein the hair accessory device has a width in the range of about 0.1 inches to about 3 inches.

6. The method of claim 1, wherein the hair accessory device further comprises a plurality of teeth on at least a portion of an interior surface of at least one of the first movable arm and the second movable arm.

7. The method of claim 6, wherein each of the plurality of teeth are triangular in shape.

8. The method of claim 1, wherein the main body is cylindrical in shape when the hair accessory device is in the closed position.

9. The method of claim 1, wherein the length of time is at least about 1 hour.

10. The method of claim 1, wherein the length of time is at least about 6 hours.

11. The method of claim 1, wherein the portion of hair is wet at the step of engaging the at least one hair accessory device with a portion of hair by closing the at least one hair accessory device around the portion of hair, and wherein the portion of hair is dry at the step of removing the hair accessory device from the portion of hair after the desired level of straightening of the portion of hair is achieved.

12. The method of claim 1, wherein the portion of hair is characterized by an initial natural curl, and wherein the portion of hair exhibits a more loosely curled state after the step of removing the hair accessory device from the portion of hair after the desired level of straightening of the portion of hair is achieved.

* * * * *